US010913595B2

(12) United States Patent
Cabilli et al.

(10) Patent No.: US 10,913,595 B2
(45) **Date of Patent: *Feb. 9, 2021**

(54) CARTRIDGE FOR PREPARING A LIQUID PRODUCT AND METHOD FOR PRODUCING IT

(71) Applicant: LUIGI LAVAZZA S.p.A., Turin (IT)

(72) Inventors: Alberto Cabilli, Turin (IT); Danilo Bolognese, Turin (IT); Luisa Borello, Turin (IT)

(73) Assignee: Luigi Lavazza S.p.A., Turin (IT)

( * ) Notice: Subject to any disclaimer, the term of this patent is extended or adjusted under 35 U.S.C. 154(b) by 0 days.

This patent is subject to a terminal disclaimer.

(21) Appl. No.: 15/319,573

(22) PCT Filed: Jun. 11, 2015

(86) PCT No.: PCT/IB2015/054420

§ 371 (c)(1),
(2) Date: Dec. 16, 2016

(87) PCT Pub. No.: WO2015/193774

PCT Pub. Date: Dec. 23, 2015

(65) Prior Publication Data

US 2017/0183145 A1 Jun. 29, 2017

(30) Foreign Application Priority Data

Jun. 18, 2014 (IT) ..... TO2014A0483

(51) Int. Cl.
*B65D 85/80* (2006.01)
*B65D 65/46* (2006.01)
*B65D 85/804* (2006.01)

(52) U.S. Cl.
CPC ..... *B65D 85/8043* (2013.01); *B65D 65/466* (2013.01)

(58) Field of Classification Search
CPC .. B65D 85/8043; B65D 65/466; B65D 43/00; B65D 43/02; B65D 43/0204;
(Continued)

(56) References Cited

U.S. PATENT DOCUMENTS 1,571,061 A * 1/1926 Nelson ..... B65D 43/00 220/602
1,961,559 A * 6/1934 Edmund ..... B65D 3/10 229/201

(Continued)

FOREIGN PATENT DOCUMENTS

EP 1 949 784 7/2008
EP 2 573 008 3/2013

(Continued)

OTHER PUBLICATIONS

"Cellulose." Merriam Webster Dictionary. <https://www.merriam-webster.com/dictionary/cellulose>. Archived Mar. 9, 2012. (Year: 2012).*

(Continued)

*Primary Examiner* — Ericson M Lachica
(74) *Attorney, Agent, or Firm* — Nixon & Vanderhye P.C.

(57) ABSTRACT

A cartridge (10) containing a dose (12) of at least one substance for preparing a liquid product, e.g., coffee, by means of liquid and/or steam introduced into the cartridge (10). The cartridge comprises a body (14) containing the aforesaid dose (12), with a bottom wall (142), through which the liquid product is able to flow out of the cartridge (10), and a cover (16) that closes the body of the cartridge (10) at the end of the body opposite to the bottom wall (142). The body (14) comprises a crushed-plant-fibre material (e.g., with a base of rice husk), which may also be used for producing the cover. Alternatively, the cover (16) may be made of paper material (e.g., filter paper). The body (14) and the cover (16) are connected together via purely mechanical (Continued)

connection, it thus being possible to avoid gluing or welding.

7 Claims, 2 Drawing Sheets

(58) Field of Classification Search
CPC .... B65D 43/021; B65D 43/06; B65D 43/065; B65D 43/08; B65D 43/162; B65D 45/00; B65D 45/16; B65D 51/14; B65D 51/00; B65D 2539/001; B65D 2543/00537; B65D 45/32; B65D 39/00; B65D 43/022; B65D 43/0254; B65D 43/0218; B65D 43/0229; B65D 3/10; B65D 2543/00481; B65D 2543/0049; B65D 2543/00555; B65D 85/804; B65D 85/8046; B65D 41/46; A47G 19/26
USPC ..... 215/224, 321, 343, 345, 346, 350, 351, 215/352, 354
See application file for complete search history.

(56) References Cited

U.S. PATENT DOCUMENTS 2,141,556 A * 12/1938 Reifsnyder ..... B65B 51/02 118/416
2,828,789 A * 4/1958 Geisler ..... B65D 43/0206 220/783
5,008,507 A * 4/1991 Pesheck ..... A23G 9/48 219/728
6,116,422 A * 9/2000 Rabe ..... B65D 43/0212 206/459.5
2007/0186784 A1* 8/2007 Liverani ..... A47J 31/0668 99/295
2010/0303965 A1* 12/2010 Mariller ..... A47J 31/3628 426/84
2010/0332419 A1* 12/2010 Bippert ..... B32B 27/10 705/500
2011/0189463 A1* 8/2011 Moore ..... D01D 5/0985 428/304.4
2011/0315703 A1* 12/2011 Urushidani ..... B65D 43/0204 220/805
2012/0058226 A1* 3/2012 Winkler ..... A47J 31/3695 426/79
2012/0070543 A1* 3/2012 Mahlich ..... B65D 85/8043 426/77
2012/0121765 A1* 5/2012 Kamerbeek ..... A47J 31/0673 426/77
2013/0236607 A1* 9/2013 Rye ..... B65D 5/0254 426/87
2013/0270176 A1* 10/2013 Schreiber ..... B65D 85/8043 210/477
2014/0083873 A1* 3/2014 Capitani ..... B65D 85/8043 206/0.5
2014/0090564 A1* 4/2014 Vanni ..... B65D 85/8043 99/295

FOREIGN PATENT DOCUMENTS

LU 37 984 A1 1/1960
WO WO 2008/148601 12/2008
WO WO 2012/164521 12/2012

OTHER PUBLICATIONS

International Search Report and Written Opinion of the ISA for PCT/IB2015/054420, dated Aug. 25, 2015, 9 pages.
Aug. 24, 2018 Extended European Search Report issued in European Application No. 18172972.4.

* cited by examiner

CARTRIDGE FOR PREPARING A LIQUID PRODUCT AND METHOD FOR PRODUCING IT

This application is the U.S. national phase of International Application No. PCT/IB2015/054420 filed Jun. 11, 2015, which designated the U.S. and claims priority to IT Patent Application No. TO2014A000483 filed Jun. 18, 2014, the entire contents of each of which are hereby incorporated by reference.

TECHNICAL FIELD

The present description relates to cartridges for preparing liquid products.

One or more embodiments may refer to cartridges for preparing beverages, for example coffee.

TECHNOLOGICAL BACKGROUND

Cartridges (or capsules or pods, according to other currently used terms) for preparing liquid products, such as, for example, a beverage, via introduction into the cartridge of liquid (which may be under pressure and/or at high temperature) and/or steam, constitute an extremely rich and articulated technological sector, as documented, for example, by FR-A-757 358, FR-A-2 373 999 (which corresponds to U.S. Pat. No. 4,136,202), FR-A-2 556 323, GB-A-938 617, GB-A-2 023 086, CH-A-406 561, U.S. Pat. Nos. 3,403,617, 3,470,812, 3,607,297 (which corresponds FR-A-1 537 031), WO-A-86/02 537, EP-A-0 199 953, EP-A-0 211 511, EP-A-0 242 556, EP-A-0 468 078, EP-A-0 469 162, EP-A-0 507 905, WO 2010/106516 A1, and EP-A-2 218 653.

A fair part of the solutions described in the documents cited regards primarily preparation of liquid products constituted by beverages, such as coffee, tea, chocolate, broth, soups, or various infusions.

With the increasing interest for the environment and for the end of life of foodstuff waste that is produced every day, a certain attention has been paid recently to the possibility of producing such cartridges with materials that can be defined—with a terminology adopted also at a patent level (see, for example, EP-B-0 497 838, EP-B-0 561 982, EP-B-0 788 733, EP-B-0 723 572, EP-B-0 868 275, EP-B-0 971 818 and EP-B-1 842 944)—as "compostable materials", for instance, according to the EN 13432 European standard.

Documents such as WO 2010/106516 A1, WO 2012/077066 A1 and WO 2012/080908 A1 describe various solutions of cartridges comprising biodegradable/compostable materials.

OBJECT AND SUMMARY

The object of one or more embodiments is to improve further the solutions described previously.

The above may apply, for example, in relation to aspects such as the possibility of providing cartridges with features that are particularly suitable for preparing hot beverages (e.g., coffee, such as espresso coffee) having characteristics of high environmental compatibility, even without the need for specific treatments and/or in relation to use of materials from renewable sources.

One or more embodiments enable the above object to be achieved thanks to a cartridge having the characteristics recalled in the ensuing claims.

One or more embodiments may also regard a method for producing one such cartridge.

The claims form an integral part of the teaching provided herein in relation to the invention.

According to one or more embodiments, to provide at least part of a cartridge (or capsule or pod) it is possible to use a material consisting of crushed plant fibre.

In one or more embodiments the material may be a thermosetting material, i.e., such as not to undergo softening when exposed to heat.

In one or more embodiments, the material may be one with a content of renewable carbon, for example, as determined according to the ASTM D6866 standard, of at least 51%.

One or more embodiments may envisage use of materials with a base of rice husk.

One or more embodiments may envisage the use of materials such as filter paper.

In one or more embodiments, parts of a cartridge can be connected together by purely mechanical coupling, it thus being possible to avoid the need to resort to connection by gluing, a solution that may present critical aspects linked to the possible contact with foodstuffs, and/or to connection by welding (either with application of direct heat or via ultrasound), a solution that is problematical to use in the presence of thermosetting materials.

In one or more embodiments, to provide the aforesaid purely mechanical coupling it is possible resort to complementary formations, one of which firmly encloses the other, countering separation of the cover from the body, i.e., fixing the cover on the body of the cartridge.

BRIEF DESCRIPTION OF THE DRAWINGS

One or more embodiments will now be described, purely by way of non-limiting example, with reference to the annexed figures, wherein.

Figure 1:
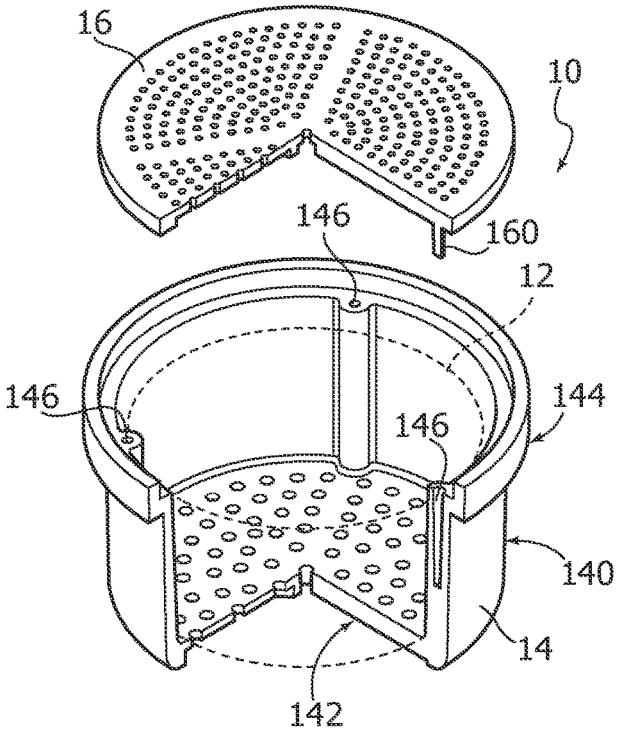
FIGS. 1 and 2 are perspective views of a cartridge according to embodiments, represented respectively in exploded view and in the assembled condition.

In the figures the cartridge is represented partially broken with a part removed for greater clarity of representation.

DETAILED DESCRIPTION

Illustrated in the ensuing description are various specific details aimed at providing an in-depth understanding of the various examples of embodiment.

The embodiments may be obtained without one or more of the specific details, or with other methods, components, or materials, etc. In other cases, known structures, materials, or operations are not illustrated or described in detail so that various aspects of the embodiments will not be obscured. Reference to "an embodiment" or "one embodiment" in the framework of the present description is intended to indicate that a particular configuration, structure, or characteristic described in relation to the embodiment is included in at least one embodiment. Hence, phrases such as "in an embodiment" or "in one embodiment" that may be present in various points of this description do not necessarily refer to one and the same embodiment. Furthermore, particular conformations, structures, or characteristics may be combined in any adequate way in one or more embodiments.

The references used herein are provided merely for the convenience of the reader and hence do not define the extent of protection or the scope of the embodiments.

In the figures, the reference number 10 designates as a whole a cartridge (or pod or capsule, these terms being used herein as equivalent) for preparing a liquid product via introduction of liquid and/or steam into the cartridge.

In one or more embodiments, the liquid product in question may be constituted by a beverage, such as for example coffee (e.g. espresso coffee or filter coffee) obtained by introducing into the cartridge liquid and/or steam under pressure and at high temperature (i.e., hot).

In any case, the repeated reference, in the framework of the present detailed description, to preparation of the beverage coffee is not to be understood as in any sense limiting the scope of the embodiments, which is altogether general.

In one or more embodiments, the cartridge 10 may contain a dose 12 of a substance that is able to form the liquid product via the aforesaid liquid and/or steam. For simplicity of representation, the dose of substance 12 is represented schematically by a dashed line only in FIGS. 1, 3, 5, and 7.

In one or more embodiments, the dose 12 may be constituted by ground coffee, or by another precursor of a liquid product, such as for example a beverage like tea, powdered or granular chocolate, products for preparing broths, soups, beverages, and infusions of various nature: this list is to be understood as being provided purely by way of example and is in no way imperative.

In one or more embodiments, in the structure of the cartridge 10, which may be shaped like a tray or small cup where the dose 12 is present, it is possible to distinguish the following:

- a body 14, comprising a side wall 140 or skirt and a bottom wall 142, which closes the body 14 at one end of the side wall 140; and
- a sealing cover 16 that closes the cartridge 10 at the end opposite to the bottom wall 142.

In this connection, it is recalled that in the figures the cartridge is represented partially broken, with a part, which corresponds approximately to a quarter of the cartridge, removed for greater clarity of representation.

In one or more embodiments, the body 14 may hence have a roughly cylindrical shape, and/or the cover may be shaped like a circular disk.

In one or more embodiments, as represented in the annexed figures, the body 14 may present a tray-like conformation at least slightly diverging from the bottom wall 142 towards the end closed by the cover 16.

In one or more embodiments, the divergent conformation may be frustoconical. This shape is not on the other hand imperative: the cartridge 14 may present as a whole different shapes, for example a prismatic shape, a frustopyramidal shape, a square shape, etc.

As will be seen more clearly in what follows, in one or more embodiments the cover 16 is designed to be connected (e.g., in a fluid-tight way) to the side wall 140 of the body 14 of the cartridge, for example at a flange that surrounds the mouth part 144 of the body 14.

In one or more embodiments (see, for example, FIGS. 7 and 8) the bottom 142 may present a sculptured structure, i.e., with some parts in relief and others set in.

In one or more embodiments (as exemplified in the figures) the cover 16 and/or the bottom 142 may be of a perforated type; i.e., they may be formed right from the start with holes in the cover 16 (for introduction of water and/or steam into the cartridge) and/or in the bottom 142 (for delivery of the beverage prepared in the cartridge 10).

In one or more embodiments, the cover 16 may present a mesh and/or filter structure.

In one or more embodiments, the cover 16 may be made of filter paper.

With the cover 16 and/or the bottom 142 of a type perforated right from the start, the cartridge 10 may be designed to be inserted in a tearable sachet or pack (e.g., a flow-pack) or a similar sealed casing in order to prevent the dose 12 from coming into contact with the environment prior to its use, thus preserving its characteristics.

In one or more embodiments, the cover 16 and/or the bottom 142 may be of a closed (non-perforated) type, thus being designed to undergo perforation only at the moment of preparation of the beverage, for example, according to the criteria discussed in some of the documents cited in the introductory part of the present description (see, for example, EP-A-0 507 905 A1).

One or more embodiments may envisage use, to obtain at least one part (e.g., the body 14) of the cartridge, of a crushed-plant-fibre material.

In one or more embodiments, the material may have a content of renewable carbon of at least 51%, as may be determined according to the ASTM D6866 standard—"Standard Test Methods for Determining the Biobased Content of Solid, Liquid, and Gaseous Samples Using Radiocarbon Analysis".

In one or more embodiments, the material may be a thermosetting material, i.e., such as not to undergo softening when exposed to heat, overcoming any possible critical aspects linked to welding and/or gluing by resorting to a purely mechanical coupling of the various parts of the cartridge.

One or more embodiments may envisage recourse, as plant-fibre material, to rice husk, for example, vegetal amalgams of rice husk, for example, in powdered form.

Husk (or chaff) derives from processing of cereals and is constituted by bracts or glumes that enclose the grain and can detach in the course of threshing and, in the case of rice, can be removed in the course of the treatment referred to as "husking".

Rice husk, also referred to as "chaff", is a waste material that is obtained in large amounts (approximately 20%) from husking of the rice with chaff after threshing. It is used, in particular in rice-growing areas, as bedding in the rearing of livestock or in gardening as mulch and for the production of small plant pots. Moreover known is its use for the production of refractory materials for ovens, in the concrete industry, for the production of furfural, which can be used as solvent in the industry of rubber and resins (e.g., polyamide), and again for processing artificial wood in so far as it is an impermeable and eco-compatible material.

In one or more embodiments, one such material may be a thermosetting material, i.e., such as not to undergo softening when exposed to heat.

In one or more embodiments, such a material may present a content of renewable carbon, which can be determined according to the ASTM D6866 standard, of at least 51%.

One or more embodiments may envisage use, to obtain at least one part (e.g., the body 14) of the cartridge, of a material as described, for example, in the document No. EP 1 949 784 A1.

In one or more embodiments, the material may be one comprising crushed plant fibre (e.g., powdered rice husk) together with an adhesive agent and a lubricant.

In one or more embodiments, the plant fibre may be mixed, added with water and a lubricant, subjected to stirring, and moulded into the desired shape (if necessary, providing the holes for its operation).

In one or more embodiments, to fix the cover 16 to the body 14, it is possible to resort to a (purely) mechanical connection, which avoids the need to resort to gluing and/or welding (e.g., hot welding or ultrasound welding).

In one or more embodiments, to provide the aforesaid purely mechanical coupling it is possible to resort to complementary formations, one of which firmly encloses the other, countering separation of the cover 16 from the body 14, i.e., fixing the cover 16 on the body 14.

Figure 2:
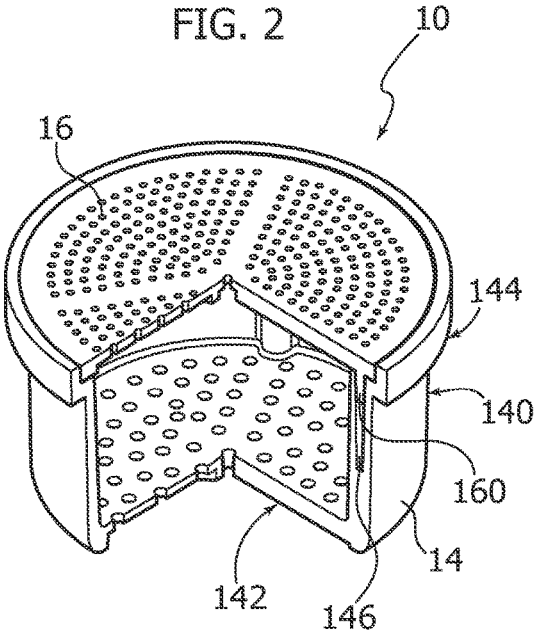

In one or more embodiments as exemplified in FIGS. 1 and 2, it is possible to provide one or more cavities that firmly enclose within them a plug element (e.g., a pin) inserted, for instance by interference fit, in the cavity, with the pin withheld in the cavity without any need to resort to glues or welding (e.g., hot welding or ultrasound welding).

In one or more embodiments as exemplified in FIGS. 3 to 8, it is possible to envisage that a rim, for instance, a peripheral rim of the cover 16 of the cartridge is firmly gripped (and hence withheld, for instance, in so far as it is at least in part pinched) in a nip, formed—according to different modalities—for example, between the mouth part of the body of the cartridge and a ring fitted on the inside or on the outside of the aforesaid mouth part, also in this case without any need to resort to glues or welding (hot welding or ultrasound welding) and with the possibility of preventing application of a considerable force on the element pinched or trapped in between. This may hence be made of a material that is not particularly strong, such as filter paper or a film of plastic material, thus moreover enabling lightening of the cartridge.

In one or more embodiments as exemplified in FIGS. 1 and 2, the cover 16 may be made of a material different from or identical to that of the body 14 (for instance, an amalgam, e.g., a vegetal amalgam, of rice husk).

In one or more embodiments, the cover 16 may be obtained (like the body 14) by moulding.

In one or more embodiments, the cover 16 may be obtained so as to present a general perforated structure (e.g., a mesh structure) to enable introduction of water and/or steam into the cartridge 10 for preparing a beverage, such as coffee.

In one or more embodiments, irrespective of whether the structure is open (perforated) or closed (perforatable at the moment of preparation of the beverage), the cover 16 may be made so as to present one or more pins 160 that project axially, for instance from the periphery of the cover 16.

In one or more embodiments, the body 14 may be made so as to present a corresponding set of one or more cavities 146 in which the pins 160 can be inserted so as to be withheld (for instance, by interference fit) in the cavities 146.

In one or more embodiments, the cavities 146 may be holes made in axial bosses provided (optionally on the inside) in the side wall 140 of the body 14.

In one or more embodiments, retention of the pins 160 by the openings 146 that firmly enclose them can derive from a general conical profile of the pins 160 and of the cavities 146, for instance, with an angle of divergence of the conicity at least slightly larger in the pins 160 with respect to the openings 146.

In one or more embodiments, the aforesaid effect of retention can derive from and/or be rendered stronger by sculptures, such as for instance, reliefs and complementary grooves, toothings, etc. present on the pins 160 and/or on the walls of the openings 146.

Optionally, in one or more embodiments, the coupling structure may be complementary to the one exemplified herein, and hence envisage pins on the body 14 and gripping cavities on the cover 16.

FIGS. 1 and 2 consequently present examples of one or more embodiments in which the complementary formations designed to counter separation of the cover from the body 14 comprise one or more pins 160 inserted in a corresponding cavity 146 that firmly encloses the pin 160. In the examples illustrated, the pin or pins 160 and the corresponding cavity or cavities are carried by the cover 16 and by the body 14, respectively.

In one or more embodiments, as exemplified in FIGS. 3 to 8, the cover 16 may be made of a laminar material such as filter paper (hence a basically compostable cellulose material), having an intrinsically perforated or open-work structure such as to enable introduction of water and/or steam into the cartridge 10 for preparing a beverage, such as coffee.

In one or more embodiments, such a cover 16 may present a plane disk-shaped configuration.

Figure 4:
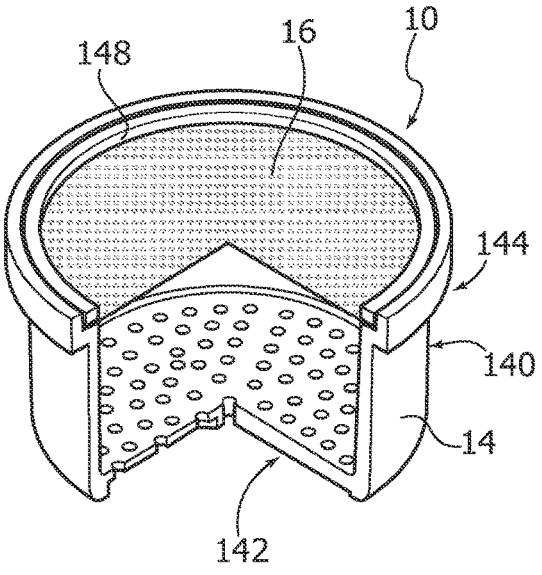
Figure 5:
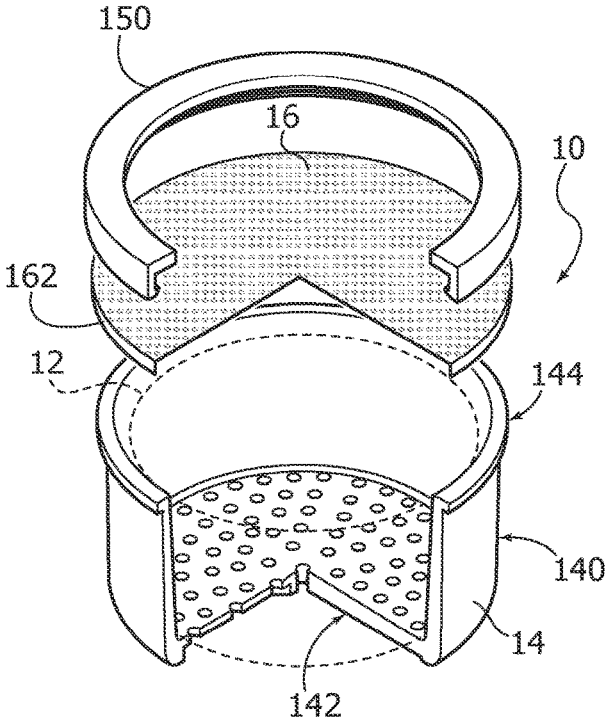
FIGS. 5 and 6 are perspective views of a cartridge according to embodiments, once again represented in exploded view and in the assembled condition, respectively.
Figure 6:
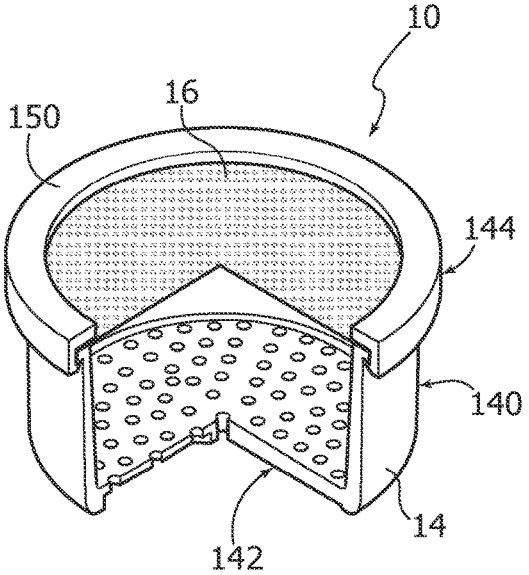

In one or more embodiments, such a cover 16 may present a peripheral rim 162 bent upwards, i.e., towards the outside of the cartridge (FIGS. 3 and 4, as well as FIGS. 7 and 8), or else downwards, i.e., towards the inside of the cartridge (FIGS. 5 and 6).

FIGS. 3 to 8 exemplify one or more embodiments in which the peripheral rim of the cover 16 is gripped in a nip formed at the mouth part of the body 14 of the cartridge 10.

Figure 3:
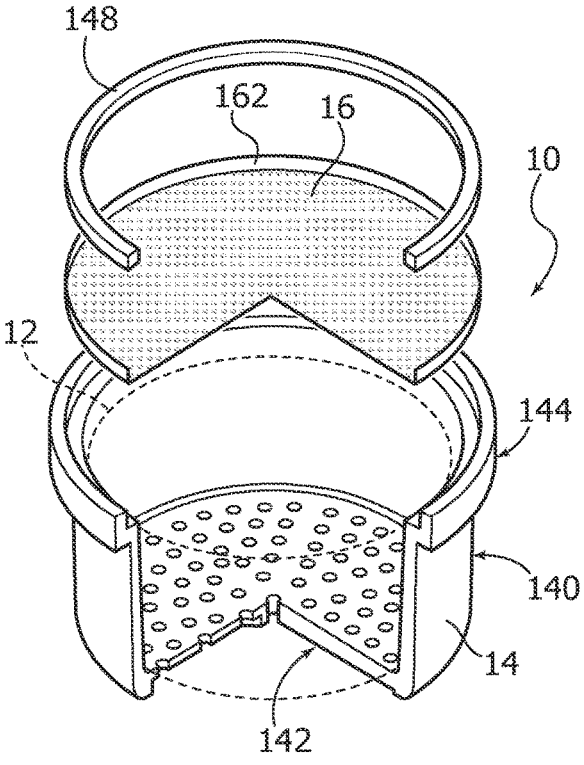
FIGS. 3 and 4 are perspective views of a cartridge according to embodiments, also here represented in exploded view and in the assembled condition, respectively.

In particular, FIGS. 3 and 4 exemplify one or more embodiments in which:

- the mouth part 144 of the body 14 has an L-shaped flange projecting towards the outside of the body 14 itself;
- the cover 16 (e.g., made of filter paper) rests peripherally on the proximal branch of this flange, possibly with the peripheral rim 162—if present—bent against the distal branch of the flange; and
- a locking ring 148 (e.g., made of a material different from or the same as that of the body 14—for instance, rice husk) is fitted inside the L-shaped flange so as to create a nip in which the perimetral part of the cover 16 is gripped, possibly with the peripheral rim 162—if present—pinched between the ring 148 and the flange.

FIGS. 5 and 6 exemplify one or more embodiments, in which:

- the mouth part 144 of the body 14 has a front flange, for instance, slightly projecting towards the outside of the body 14 itself;
- the cover 16 (e.g., made of filter paper) rests peripherally on said flange, possibly with the peripheral rim 162—if present—bent towards the body 14 to embrace of the flange externally; and
- a locking ring 150 (for instance, made of a material different from or the same as that of the body 14—e.g., rice husk) with L-shaped profile, fitted, for instance by snap action, on the outside of the L-shaped flange so as to create a nip in which the boundary of the cover 16 is gripped, possibly with the peripheral rim 162—if present—pinched between the flange and the locking ring 150.

Figure 7:
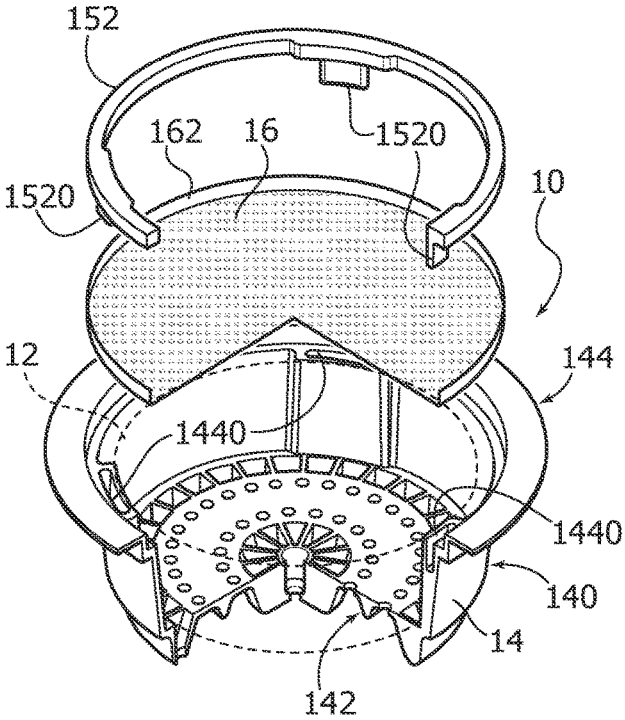
FIGS. 7 and 8 are perspective views of a cartridge according to embodiments; also in this case the cartridge is here represented in exploded view and in the assembled condition, respectively.
Figure 8:
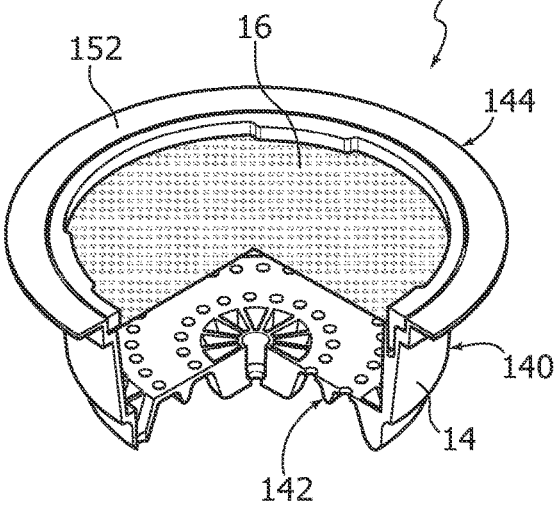

FIGS. 7 and 8 exemplify one or more embodiments, in which:

the mouth part 144 of the body 14 has a flange with an L-shaped part projecting towards the outside of the body 14 and having an annular extension according to a general Z-shaped profile;

the cover 16 (e.g., made of filter paper) rests peripherally on the proximal branch of the L-shaped part of the flange, possibly with the peripheral rim 162—if present—bent against the distal branch of the L-shaped part of the flange; and a locking ring 152 (for instance, made of a material different from or the same as that of the body 14—e.g., rice husk), fitted inside the L-shaped flange so as to create a nip, gripped in which is the perimetral part of the cover 16, possibly with the peripheral rim 162—if present—pinched between the ring 152 and the flange; in this case the ring 152 is fitted in the body 14 with the provision of one or more toothed pins 1520 that are inserted into a corresponding set of one or more openings 1440.

In one or more embodiments, the openings 1440 may be made in bosses provided in the side wall 140 of the body 14.

In one or more embodiments as exemplified, in addition to gripping of the peripheral rim of the cover 16 in the nip formed by the ring 152 and by the flange of the body 14, the openings 1440 firmly enclose the teeth 1520. Consequently, also in this case a purely mechanical connection is provided that avoids the need for gluing and/or welding.

Also in the case of the teeth 1520 and of the openings 1440, in one or more embodiments, retention of the teeth 1520 in the openings 1440 may derive from, and/or be rendered stronger by, sculptures, such as for instance, reliefs and complementary grooves, toothings, etc. present on the teeth 1520 and/or on the walls of the openings 1440.

Optionally, in one or more embodiments, the coupling structure may be complementary to what has been exemplified herein and hence envisage pins on the body 14 and cavities on the ring 152.

FIGS. 3 to 8 consequently exemplify one or more embodiments in which the complementary formations designed to counter separation of the cover 16 from the body 14 comprise:

a rim 162; and a nip (FIGS. 3 and 4), or (FIGS. 5 and 6), or (FIGS. 7 and 8), which firmly grips the rim 162.

In the examples illustrated, the nip and the rim are carried, respectively, by the body 14 and by the aforesaid cover 16.

Optionally, in one or more embodiments, the coupling structure may be complementary to the one exemplified herein and hence envisage the presence on the cover 16 of a nip that is able to function as cavity for gripping an annular relief provided on the inner surface of the body 14.

In one or more embodiments, the snap-action coupling previously envisaged for a ring fitted on the outside of the mouth part of the body 14 (see, for instance, the ring 150 of FIGS. 5 and 6) can be adopted for a ring fitted inside the mouth part of the body 14 (see, for instance, the rings 148 and 153 of FIGS. 3 and 4 and of FIGS. 7 and 8)

In one or more embodiments, the coupling structure may be complementary to the one exemplified herein and hence envisage the presence on the cover 16 of a nip that is able to function as cavity for gripping an annular relief provided on the inner surface of the body 14.

It will be appreciated that in one or more embodiment, as exemplified herein, the connection of the cover 16 to the body 14 may be obtained by a labyrinth conformation (for instance, on the rim 162 gripped or pinched between a flange and a ring) that is able to improve the fluid tightness between the parts connected together.

It may moreover be appreciated that, in one or more embodiments, the various ring formations envisaged herein do not necessarily have to be closed-ring ones, but may be open-ring formations.

It will again be appreciated that individual details of construction presented herein with reference to one or more of the annexed figures may be transposed to embodiments exemplified in the various figures.

Some materials that can be used for providing one or more embodiments may require a thermal process of post-crystallization after moulding.

In one or more embodiments, such a process may be carried out after packaging of the cartridge 10 (i.e., after the dose 12 has been introduced into the body 14 and the cartridge 10 has been closed by applying the cover 16 on the body 14), for instance to bring about consequent shrinkage of the material useful for relative fixing of the various parts of the cartridge 10.

Of course, without prejudice to the principle of the invention, the details of construction and the embodiments may vary, even significantly, with respect to what is illustrated herein purely by way of non-limiting example, without thereby departing from the extent of protection of the invention, the extent of protection being defined by the annexed claims.

The invention claimed is:

1. A cartridge with a filling of at least one substance for preparing a liquid product by means of liquid and/or steam introduced into the cartridge, the cartridge including:

a casing containing said filling, said casing having a bottom wall for said liquid product to flow from the cartridge, and a cover closing the casing of the cartridge at an end of the casing opposite said bottom wall, wherein at least said casing includes a crushed plant fiber material and said cover is retained on said casing via complementary formations of which one encloses the other thereby opposing the separation of the cover from the casing, wherein said complementary formations include a peripheral edge of the cover, which peripheral edge has a portion that is perpendicular to a remainder of the cover, and a nip which acts to enclose said peripheral edge of the cover thereby opposing the separation of the cover from the casing, wherein:

the casing has a mouth portion with an L-shaped shoulder flange, the peripheral edge of the cover rests on said L-shaped shoulder flange, and a locking ring rests on a portion of the cover so as to create the nip, wherein the peripheral edge of the cover is pinched between the locking ring and the L-shaped shoulder flange of the casing, wherein the locking ring is fitted inside the L-shaped shoulder flange of the casing.

2. The cartridge of claim 1, wherein said crushed plant fiber material is a thermosetting material.

3. The cartridge of claim 1, wherein said crushed plant fiber material contains renewable carbon contents, determined according to the ASTM D6866 standard, of at least 51%.

4. The cartridge of claim 1, wherein said crushed plant fiber material includes rice husk.

5. The cartridge of claim 4, wherein said crushed plant fiber material includes an amalgam of rice husk.

6. The cartridge of claim 1, wherein:

both said casing and said cover include a plant fiber material, or said casing includes the crushed plant fiber material and said cover includes a paper material.

7. The cartridge of claim 1, wherein at least one of said cover and said bottom wall has an apertured structure.

* * * * *